US005247870A

United States Patent [19]

Brasca et al.

[11] Patent Number: 5,247,870

[45] Date of Patent: Sep. 28, 1993

[54] COMBINED PNEUMATIC-HYDRAULIC PRESS WITH CONTROLLED STROKE

[76] Inventors: Carlo Brasca; Daniele Brasca, both of Via Puccini 13, 20085 Locate di Triulzi (Province of Milano), Italy

[21] Appl. No.: 838,166

[22] Filed: Feb. 20, 1992

[30] Foreign Application Priority Data

Feb. 28, 1991 [IT] Italy ..... MI91A-000524

[51] Int. Cl.[5] ..... F15B 11/00

[52] U.S. Cl. ..... 91/519; 91/520; 60/560; 60/565; 60/593

[58] Field of Search ..... 92/61, 13.8, 13.3; 91/4 R, 519, 520, 525, 535, 511; 60/560, 563, 565, 593

[56] References Cited

U.S. PATENT DOCUMENTS

| | | | |
|---|---|---|---|
| 3,059,433 | 10/1962 | Hirsch | 91/525 |
| 3,958,493 | 5/1976 | Fujita et al. | 92/13.8 |
| 4,072,013 | 2/1978 | Barbareschi | 60/593 |
| 4,288,987 | 9/1981 | Grullmeier | 60/560 |
| 4,300,351 | 11/1981 | Grullmeier | 60/565 |
| 4,961,317 | 10/1990 | Wolfbauer . | |

FOREIGN PATENT DOCUMENTS

| | | | |
|---|---|---|---|
| 0023030 | 1/1981 | European Pat. Off. . | |
| 0355780 | 2/1990 | European Pat. Off. . | |
| 2017007 | 10/1971 | Fed. Rep. of Germany . | |
| 862090 | 3/1961 | United Kingdom . | |
| 2027809 | 2/1980 | United Kingdom | 60/560 |

*Primary Examiner*—Thomas E. Denion

*Attorney, Agent, or Firm*—Guido Modiano; Albert Josif

[57] ABSTRACT

The combined pneumatic-hydraulic press with controlled stroke, includes a body inside which a substantially cylindrical main chamber is defined; the main chamber accommodates, so that it can slide along an axial direction, a working piston which protrudes from the body with its stem. The working piston delimits, in the main chamber, a first compartment which contains a liquid and is connected, through a passage, to a secondary chamber which is provided with elements for exerting pressure on the liquid contained in the secondary chamber in order to transfer at least part of the liquid from the secondary chamber to the first compartment in order to axially move the working piston. Cut-off elements are provided on the passage and can be controllably activated in order to hydraulically isolate the first compartment from the secondary chamber, and there is an actuation piston which is provided with a stem which can be sealingly inserted in the first compartment in order to increase the hydraulic pressure inside the first compartment, with an increase in the actuation force which acts on the working piston parallel to its axis. The press furthermore comprises elements for delimiting the stroke of the working piston.

5 Claims, 4 Drawing Sheets

COMBINED PNEUMATIC-HYDRAULIC PRESS WITH CONTROLLED STROKE

BACKGROUND OF THE INVENTION

The present invention relates to a combined pneumatic-hydraulic press with controlled stroke.

Combined pneumatic-hydraulic presses are known which generally comprise a head constituted by a substantially cylindrical body in which a cylindrical main chamber is defined; said main chamber accommodates a working piston so that it can slide axially, and the stem of said piston protrudes from one side of the head. This stem constitutes the element of the press which, associated with various types of tools, performs the various treatments for which presses are normally used, such as clamping, blanking, marking, straightening, riveting, calking, coining, bending, drawing, keying, etc.

The main chamber can be selectively connected, on opposite sides with respect to the working piston, to a source of compressed air or to the atmosphere so as to rapidly move, with a reduced force, the stem toward or away from the working surface on which the part to be treated is arranged.

The working piston is generally provided with a wing which extends on the opposite side with respect to the stem and can slide in a chamber which is filled with liquid. Said liquid-containing chamber has a narrower portion in which the stem of a pneumatically-actuated piston can slide sealingly. The assembly constituted by the liquid-containing chamber, by the wing of the working piston and by the stem of said pneumatically-actuated piston constitutes a hydraulic press in which the actuation force of the stem which slides in the narrower portion of the liquid-containing chamber is multiplied and transmitted to the working piston in order to obtain an adequate force during the working step.

These types of presses with combined pneumatic-hydraulic actuation, despite having undeniable advantages with respect to presses with exclusively hydraulic actuation, have some problems.

Since the working piston is conceived like the piston of a double-action pneumatic cylinder, during the rapid approach step said working piston in fact draws the liquid contained in the chamber in which the wing which constitutes an element of the hydraulic press slides. This drawing action, allowed by a compensation element which sends liquid into said chamber or keeps its volume constant by means of another sliding piston which delimits the chamber on the side opposite to said wing, exerts a braking effect on the working piston, reducing its speed of approach to the part to be treated or requiring greater pneumatic power in order to obtain the required speed. Furthermore, the filling of the chamber with liquid can be incomplete, causing operating anomalies, in case of high actuation speeds.

Another disadvantage which can be observed in presses with combined pneumatic-hydraulic actuation is that it is not possible to precisely control the stroke of the working piston. Due to the way in which currently commercially available combined pneumatic-hydraulic presses are structured, the stroke of the working piston can in fact be controlled only indirectly and with scarce precision by controlling the stroke of the pneumatically-actuated piston.

Due to this fact, currently commercially available combined pneumatic-hydraulic presses cannot be used to actuate machines, such as for example rolling machines, machines for inserting dowels, rivets etc., which have a controlled amount of penetration and require an extremely precise working piston stroke; due to this reason, these types of machines are currently actuated by means of hydraulic or pneumatic actuators equipped with levers for controlling the stroke of the working piston.

SUMMARY OF THE INVENTION

The aim of the present invention is to obviate the above described problems by providing a combined pneumatic-hydraulic press which has a high actuation speed and allows an extremely precise control of the stroke of the working piston, so that it can be used not only for the uses to which combined pneumatic-hydraulic presses are currently assigned but also for other applications which require higher precision.

Within the scope of this aim, an object of the invention is to provide a combined pneumatic-hydraulic press which, despite having an extremely precise working piston stroke adjustment, has a structure which is simple to provide with modest manufacturing costs.

Another object of the invention is to provide a combined pneumatic-hydraulic press which has a reduced bulk in a direction parallel to the working direction.

A further object of the invention is to provide a combined pneumatic-hydraulic press which, by virtue of the high working speeds it can achieve, has an increased productive potentiality with respect to known combined pneumatic-hydraulic presses.

This aim, these objects and others which will become apparent hereinafter are achieved by a combined pneumatic-hydraulic press with controlled stroke, characterized in that it comprises a body which internally defines a substantially cylindrical main chamber which accommodates, so that it can slide along an axial direction, a working piston which protrudes from said body with its stem, said working piston delimiting, in said main chamber, a first compartment which contains a liquid and is connected, through a passage, to a secondary chamber which is provided with means suitable for exerting pressure on the liquid contained in said secondary chamber in order to transfer at least part of the liquid from said secodary chamber to said first compartment in order to axially move said working piston, means for cutting off said passage being provided, said cutoff means being controllably activatable in order to hydraulically isolate said first compartment from said secondary chamber, and an actuation piston which has a stem which can be sealingly inserted in said first compartment in order to determine an increase in the hydraulic pressure inside said first compartment, with an increase in the actuation force which acts on said working piston parallel to its axis, means being furthermore provided for delimiting the stroke of said working piston.

BRIEF DESCRIPTION OF THE DRAWINGS

Further characteristics and advantages of the invention will become apparent from the description of two preferred but not exclusive embodiments of the combined pneumatic-hydraulic press according to the invention, illustrated only by way of non-limitative example in the accompanying drawings, wherein:

FIG. 1 is a schematic axial sectional view of the press in idle conditions;

FIG. 2 is an axial sectional view, similar to FIG. 1, of the press during rapid approach to the part to be treated;

FIG. 3 is an axial sectional view, similar to the preceding figures, of the press during the working step.

DESCRIPTION OF THE PREFERRED EMBODIMENTS

Figure 1:
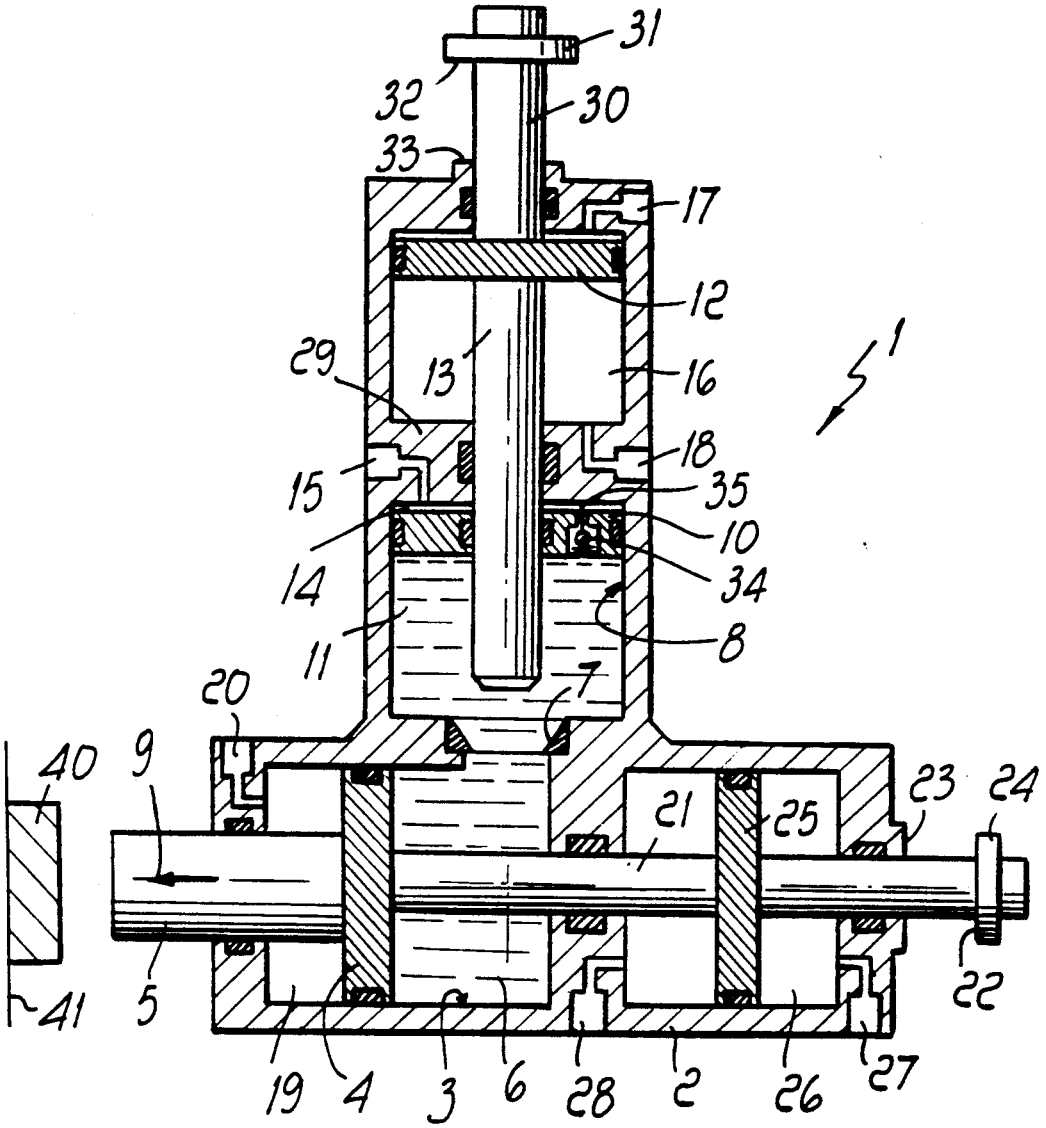
FIGS. 1 to 3 are views of the pres according to the invention in the first embodiment, which relates to a press with a substantially horizontal working direction, and more particularly.

With reference to the above figures, the press according to the invention, generally designated by the reference numerals 1 and 1a in the two embodiments, comprises a body 2, 2a which internally defines a main chamber 3, 3a which has a cylindrical configuration. Said main chamber accommodates a working piston 4, 4a which can slide axially and protrudes from the body 2, 2a with its stem 5, 5a. The working piston 4, 4a delimits, in the main chamber 3, 3a, a first compartment 6, 6a which is filled with liquid and is connected, through a passage 7, 7a, with a secondary chamber 8, 8a which also contains liquid. The secondary chamber 8, 8a is provided with means which are suitable for exerting pressure on the liquid in order to move at least part of said liquid from the secondary chamber 8, 8a to the first compartment 6, 6a in order to axially move the working piston 4, 4a along a working direction indicated by the arrow 9, 9a in the figures.

In the illustrated embodiments, the means for producing pressure on the liquid contained in the secondary chamber are constituted by a secondary piston 10, 10a which is slidingly accommodated in the secondary chamber and delimits a second compartment 11, 11a which is connected to the first compartment 6, 6a through the passage 7, 7a.

The press according to the invention is furthermore provided with an actuation piston 12, 12a which has a stem 13, 13a which can be inserted in the first compartment 6, 6a in order to increase the hydraulic pressure inside said first compartment 6, 6a and thus increase the actuation force which acts on the working piston 4, 4a.

Cutoff means are provided at the passage 7, 7a and isolate the first compartment 6, 6a from the second compartment 11, 11a when the stem 13, 13a of the actuation piston 12, 12a is inserted in the first compartment 6, 6a.

Advantageously, said cutoff means are constituted by the stem 13, 13a itself, which is inserted in the first compartment 6, 6a through said passage 7, 7a, sealingly closing it.

Conveniently, the stem of the actuation piston 12, 12a is arranged transversely to the axis of the working piston 4, 4a, i.e. transversely to the working direction 9, 9a.

More particularly, the secondary piston 10, 10a sealingly divides the secondary chamber 8, 8a into the second compartment 11, 11a and into a third compartment 14, 14a which can be connected, by means of a port 15, 15a, to a source of compressed air or to the atmosphere in order to axially move the secondary piston 10, 10a along the secondary chamber 8, 8a.

The actuation piston 12, 12a can slide inside a substantially cylindrical actuation chamber 16, 16a which is sealingly separated from the secondary chamber 8, 8a. Said actuation chamber 16, 16a is defined, like the secondary chamber 8, in a portion of the body 2 which extends transversely to the axis of the working piston and can be connected, through ports 17, 17a and 18, 18a arranged on opposite sides with respect to the actuation piston 12, 12a, to a source of compressed air or to the atmosphere in order to axially move the actuation piston 12, 12a.

Figure 2:
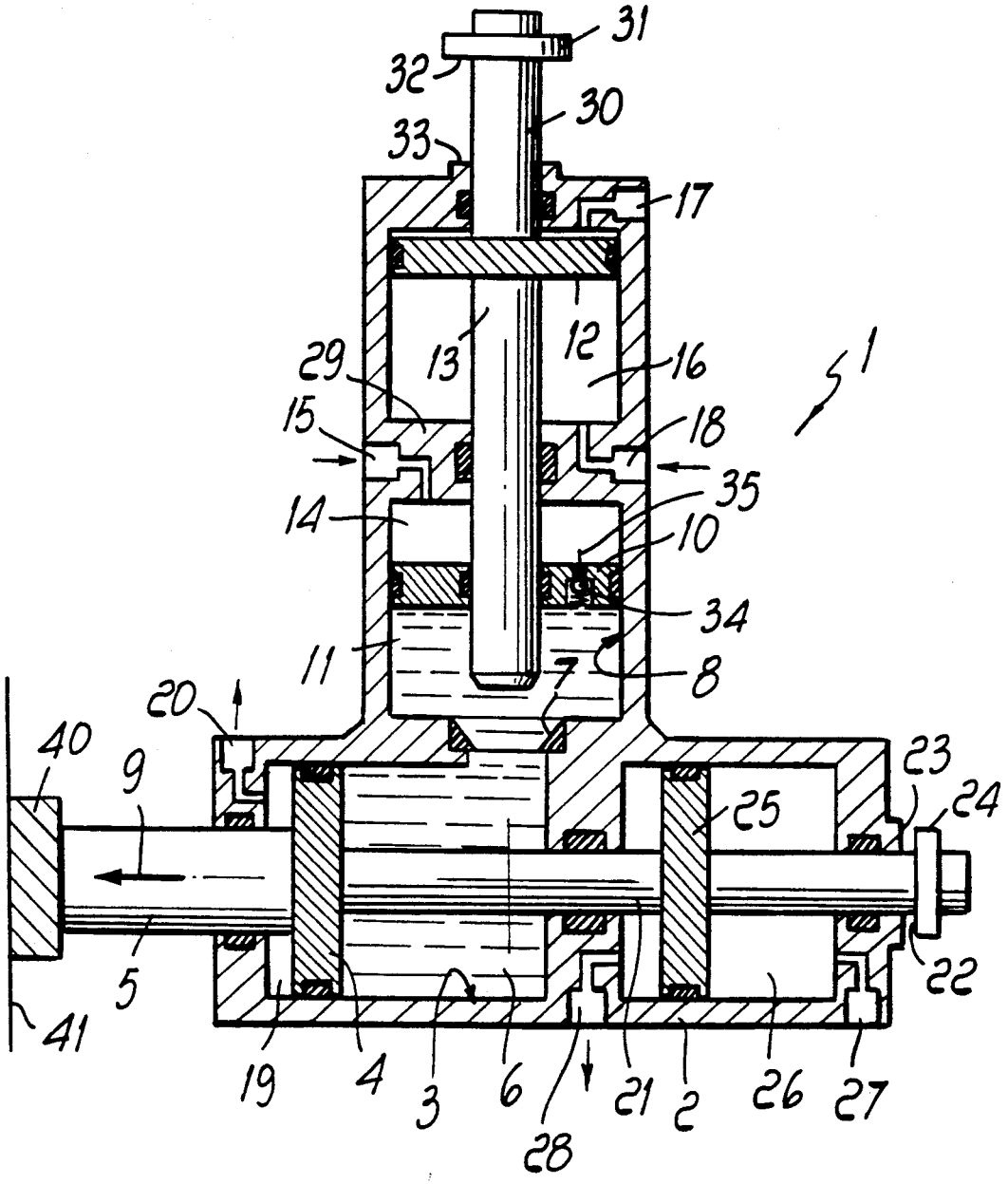
Figure 3:
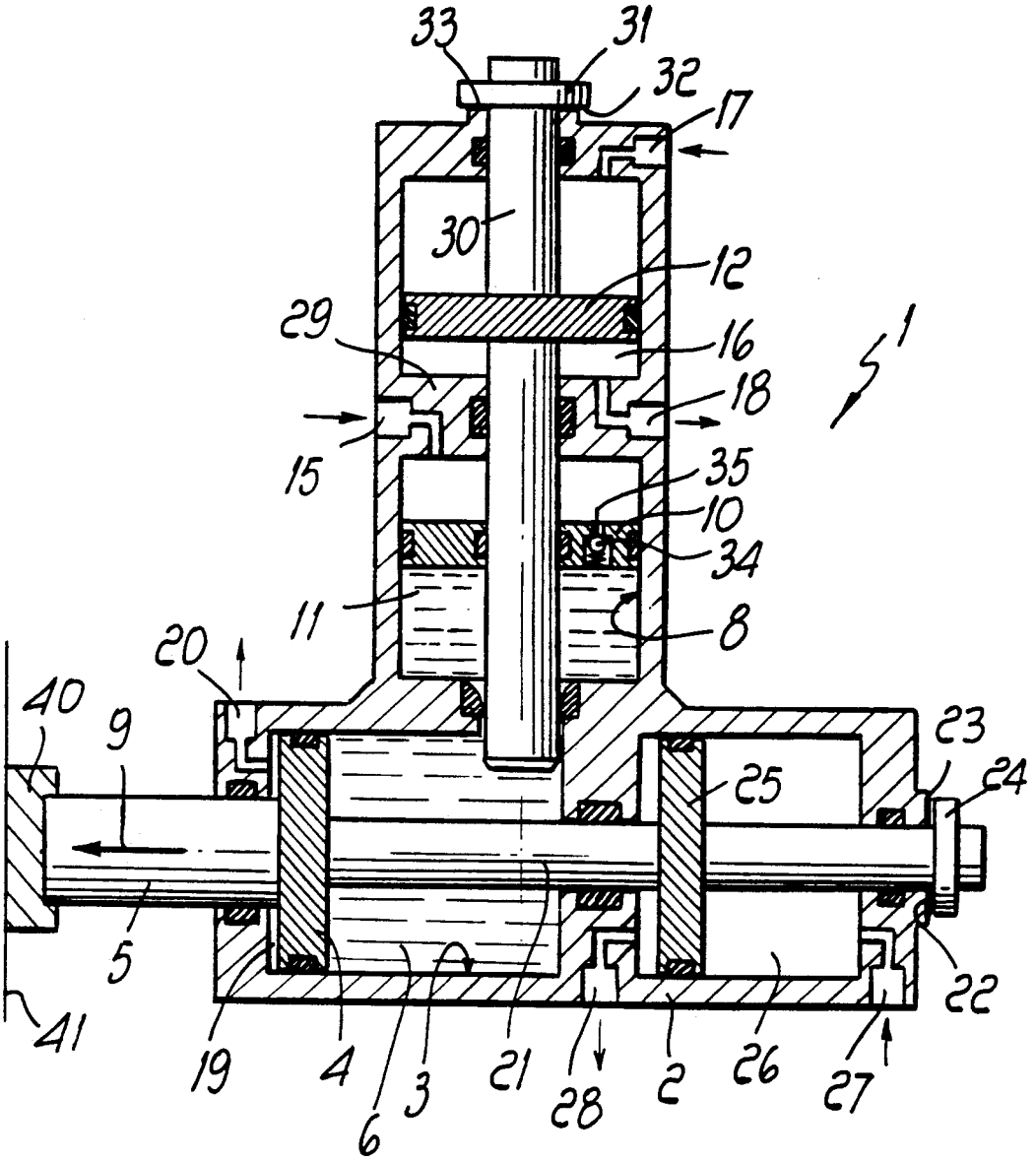
Figure 4:
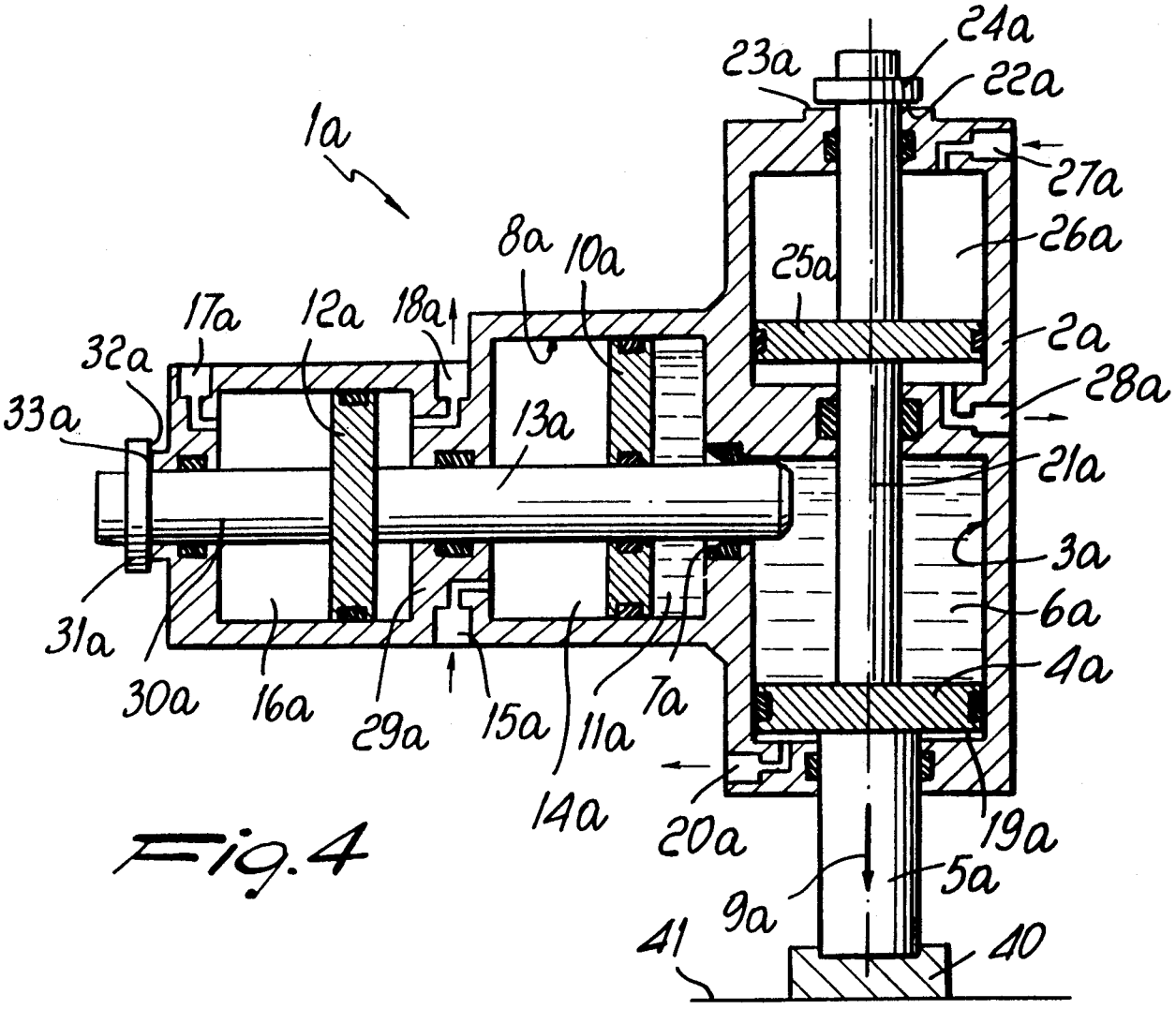
FIG. 4 is an axial sectional view of the press in the second embodiment, which relates to a press having a substantially vertical working direction, during the working step.

The stem 13, 13a of the actuation piston 12, 12a sealingly and slidingly passes through the secondary piston 10, 10a in order to reach the passage 7, 7a. In the first embodiment, illustrated in FIGS. 1 to 3, the actuation piston 12, with its stem 13, is arranged coaxially to the secondary piston 10, whereas in the second embodiment, illustrated in FIG. 4, the actuation piston 12a with its stem 13a has an axis which is parallel but spaced with respect to the axis of the secondary piston 10a.

A fourth compartment 19, 19a is defined between the working piston 4, 4a and the end of the main chamber 3 through which the stem 5, 5a protrudes; said fourth compartment can be connected, through a port 20, 20a, to a source of compressed air or to the atmosphere in order to obtain the return motion of the working piston 4, 4a or allow its advancement along the working direction 9, 9a. Alternatively, it is possible to insert a spring between the end of the main chamber 3, 3a from which the stem 5, 5a protrudes and the working piston 4, 4a; said spring may contrast the advancement of the working piston along the working direction 9 and obtain the return motion of the working piston.

According to the invention, means are provided for delimiting the stroke of the working piston 4, 4a; in the illustrated embodiments, said means comprise a shaft 21, 21a which is rigidly associated with the working piston 4, 4a and extends coaxially thereto on the opposite side with respect to the stem 5, 5a. Said shaft 21, 21a protrudes, with a longitudinal end, from the body 2, 2a on the opposite side with respect to the stem 5, 5a, and a shoulder 22, 22a is provided on the portion thereof which is external to the body 2 and is intended to engage against an abutment 23, 23a defined by said body 2, 2a.

The shoulder 22, 22a can conveniently be provided by means of a ring 24, 24a which engages a thread defined on the shaft 21, 21a so as to allow an extremely precise adjustment of the position of the shoulder 22, 22a along the axis of the shaft 21, 21a.

An auxiliary piston 25, 25a can be connected to an intermediate portion of the shaft 21, 21a and can slide inside an auxiliary chamber 26, 26a which is sealingly separated from the first compartment 6, 6a. The auxiliary chamber 26, 26a can be connected, through auxiliary ports 27, 27a and 28, 28a arranged on opposite sides with respect to the auxiliary piston 25, 25a, to a source of compressed air or to the atmosphere in order to aid the working piston 4, 4a in its movement in the working direction 9,9a or in the opposite direction. Alternatively, the movement of the auxiliary piston 25, 25a in one of the two actuation directions can be obtained by means of a spring which is arranged around the shaft 21, 21a in one of the two parts into which the chamber 26, 26a is divided and is interposed between the piston 25, 25a and an axial end of the compartment 26, 26a.

Thus, equally, the return motion of the actuation piston 12, 12a can be obtained by means of a spring which is arranged around the stem 13, 13a and is interposed between the actuation piston 12, 12a and the wall 29, 29a which sealingly separates the actuation chamber 16, 16a from the secondary chamber 8, 8a.

Advantageously, the actuation piston 12, 12a is provided with a shaft 30, 30a which extends on the opposite side with respect to the stem 13, 13a and protrudes with one of its ends from the actuation chamber 16, 16a. This end of the shaft 30, 30a is threaded and coupled to an adjustment ring 31, 31a which, similarly to the ring 24, 24a, defines a stroke-limit shoulder 32, 32a which faces an abutment 33, 33a defined by the body 2 itself around the shaft 30 so as to stop the stroke of the actuation piston 12, 12a. In order to vary the stroke of the actuation piston 12, 12a it is sufficient to screw or unscrew the ring 31, 31a further along the shaft 30.

Conveniently, in the combined pneumatic-hydraulic press in the first embodiment, in which the axis of the secondary chamber 8 is arranged vertically, the secondary piston 10 is provided with valve means for venting any air present in the liquid contained in the first compartment and in the second compartment. Said valve means can be simply constituted by a check valve 34, provided with a needle 35 which protrudes from the secondary piston 10 from the side thereof which i directed toward the wall 29, which is opened by virtue of the contact of said needle 35 against the wall 29 when the secondary piston 10 is at the end of its return stroke.

In the two illustrated embodiments, the axis of the actuation piston 12, 12a is arranged substantially perpendicular to the axis of the working piston 4, 4a, but the inclination between these two axes might be different according to the requirements.

It should be furthermore noted that in the first embodiment, in which the secondary chamber 8 extends vertically, the use of the secondary piston 10 may be superfluous.

The operation of the combined pneumatic-hydraulic press according to the invention is as follows.

When the press is in idle conditions, the stem 5, 5a of the working piston 4, 4a is spaced from the part 40 to be treated, which is arranged on the working surface 41. In these conditions, the secondary piston 10, 10a is proximate to the wall 29 and the stem 13, 13a of the actuation piston 12, 12a is disengaged from the passage 7, 7a which connects the first compartment 6, 6a to the second compartment 11, 11a.

When the part 40 is to be subjected to the action of the press, the port 15, 15a is connected to a source of compressed air which moves the secondary piston 10, 10a away from the wall 29. This movement reduces the volume of the second compartment 11, 11a, pushing part of the liquid contained therein into the first compartment 6, 6a. The movement of the liquid from the second compartment to the first compartment causes the rapid axial movement of the working piston 4, 4a, whose stem 5, 5a reaches the part 40 to be treated. In this step it is possible to assist the movement of the working piston 4, 4a by connecting the port 27, 27a to a source of compressed air.

When approach has occurred, the port 17, 17a is connected to a source of compressed air and the port 18, 18a is connected to the atmosphere, so as to axially move the actuation piston 12, 12a and make the stem 13, 13a pass through the passage 7, 7a and enter the first compartment 6, 6a. The advancement of the stem 13, 13a inside the first compartment 6, 6a causes an increase in the hydraulic pressure inside the first compartment and thus increases the force which acts on the working piston 4, 4a so as to obtain the force required to perform the further advancement of the working piston 4, 4a in order to treat the part 40.

The advancement of the working piston 4, 4a induced by the advancement of the stem 13, 13a of the actuation piston 12, 12a inside the first compartment 6, 6a continues until the shoulder 22, 22a abuts against the abutment 23, 23a which stops the stroke of the working piston 4, 4a.

When treatment is complete, the port 17, 17a is connected to the atmosphere and the port 18, 18a is connected to a source of compressed air so as to cause the return motion of the actuation piston 12, 12a and thus the disengagement of its stem 13, 13a from the passage 7, 7a. The ports 15, 15a and 27, 27a are subsequently connected to the atmosphere, whereas the ports 20, 20a and 28, 28a are connected to a source of compressed air so as to disengage and space the working piston 4, 4a with its stem 5, 5a from the treated part 40.

At this point the working cycle resumes as already described.

In practice it has been observed that the combined pneumatic-hydraulic press according to the invention fully achieves the intended aim, since by virtue of the fact that the advancement of the working piston is obtained by acting directly on the liquid, higher actuation speeds are achieved with respect to conventional combined pneumatic-hydraulic presses with equal power utilization; furthermore, the possibility of controlling the stroke of the working piston in an extremely precise and reliable manner not only allows greater precision in treatments for which combined pneumatic-hydraulic presses are currently used but also extends the field of application of these presses to treatments which require such control, such as for example treatments which currently use rolling machines, drawing machines, etc., avoiding mechanical stroke limiters on the dies as well.

A further advantage is constituted by the fact that the end of the shaft 21 which protrudes from the body 2 can be used as power take-off, for example in extractors or other devices.

The combined pneumatic-hydraulic press thus conceived is susceptible to numerous modifications and variations, all of which are within the scope of the inventive concept; all the details may furthermore be replaced with technically equivalent elements.

In practice, the materials employed, as well as the dimensions, may be any according to the requirements and to the state of the art.

We claim:

1. Combined pneumatic-hydraulic press with controlled stroke comprising;

a body (2, 2a);

a main chamber (3, 3a) defined in said body (2, 2a) and being filled with liquid;

a working piston (4, 4a) slideably accommodated in said main chamber (3, 3a) and defining a working piston stroke;

a stem (5, 5a) connected to said working piston (4, 4a) and protruding from said body (2, 2a);

a first compartment (6, 6a) delimited by said working piston (4, 4a) in said main chamber (3, 3a) and being filled with liquid;

a secondary chamber (8, 8a) filled with liquid and being axially transverse with respect to said first compartment;

a passage (7, 7a) interconnecting said first compartment (6, 6a) and said secondary chamber (8, 8a);

a secondary piston (10, 10a) slideably sealingly accommodated in said secondary chamber (8, 8a);

a second compartment (11, 11a) defined within said secondary chamber (8, 8a) between said secondary piston (10, 10a) and said passage (7, 7a);

a third compartment (14, 14a) defined within said secondary chamber (8, 8a) at an opposite side of said secondary piston (10, 10a) with respect to said passage (7, 7a);

means (15) communicating with said third compartment (14, 14a) for moving said secondary piston (10, 10a) along said secondary chamber (8, 8a), whereby to displace a quantity of said liquid from said second compartment (11, 11a) into said main chamber (3, 3a) to rapidly axially displace said working piston (4, 4a) along said main chamber (3, 3a) and move said stem (5, 5a) into engagement with a workpiece (40) to be treated;

an actuation stem (13, 13a) sealingly slideably penetrating said secondary piston (10, 10a) and axially penetrating said secondary chamber (8, 8a) and said second compartment (11, 11a), said actuating stem (13, 13a) being sealingly slideably engageable within said passage (7, 7a) for transversely penetrating said main chamber (3, 3a), whereby to cause compression of said liquid contained in said main chamber (3, 3a) and increase actuation force on said working piston (4, 4a) and said stem (5, 5a) for treating a workpiece (40);

actuating means (12, 12a, 16, 16a, 17, 17a, 18, 18a) for moving said actuation stem (13, 13a) into said main chamber (3, 3a) through sliding engagement with said passage (7, 7a);

means (19, 19a, 20, 20a) for actuating return motion of said working piston (4, 4a), and;

means (21, 21a, 22, 22a, 23, 23a) for delimiting said working piston stroke, wherein said actuating means (12, 12a, 16, 16a, 17, 17a, 18, 18a) comprise;

substantially cylindrical actuation chamber (16, 16a) sealingly separated from said secondary chamber (8, 8a);

an actuation piston (12, 12a) connected to said stem (13, 13a) and being slideably sealingly accommodated within said actuation chamber (16, 16a), and;

ports (17, 17a, 18, 18a) arranged on opposite side of said actuation chamber (16, 16a) with respect to said actuation piston (12, 12a) and being connectable to a source of compressed air for axially moving said actuation piston (12, 12a) along said actuation chamber (16, 16a), and wherein said actuation stem (13a), said actuation piston (12, 12a) and said actuation chamber (16, 16a) are eccentric with respect to said secondary piston (10a).

2. Combined pneumatic-hydraulic press with controlled stroke according to claim 1, wherein said means (21, 21a, 22, 22a, 23, 23a) for delimiting said working piston stroke comprise;

a shaft (21, 21a) connected to an opposite side of said working piston (4, 4a) with respect to said stem (5, 5a), said shaft protruding from an opposite said of said body (2, 2a) with respect to said stem (5, 5a);

an abutment (23, 23a) defined by said body (2, 2a), and;

a shoulder (22, 22a) provided on said shaft (21, 21a) externally of said body (2, 2a) and being engageable with said abutment (23, 23a) in abutment engagement relationship therewith, and further comprising;

an auxiliary chamber (26, 26a) sealingly separated from said first compartment (6, 6a);

an auxiliary piston (25, 25a) connected to said shaft (21, 21a) and being slideably accommodated in said auxiliary chamber (26, 26a), and;

auxiliary ports (27, 27a, 28, 28a) arranged on opposite sides of said auxiliary chamber (26, 26a) with respect to said auxiliary piston (25, 25a) and connectable to a source of compressed air, whereby to aid said working piston stroke of said working piston (4, 4a) in a working direction (9, 9a).

3. Combined pneumatic-hydraulic press with controlled stroke comprising;

a body (2, 2a);

a main chamber (3, 3a) defined in said body (2, 2a) and being filled with liquid;

a working piston (4, 4a) slideably accommodated in said main chamber (3, 3a) and defining a working piston stroke;

a stem (5, 5a) connected to said working piston (4, 4a) and protruding from said body (2, 2a);

a first compartment (6, 6a) delimited by said working piston (4, 4a) in said main chamber (3, 3a) and being filled with liquid;

a secondary chamber (8, 8a) filled with liquid and being axially transverse with respect to said first compartment;

a passage (7, 7a) interconnecting said first compartment (6, 6a) and said secondary chamber (8, 8a);

a secondary piston (10, 10a) slideably sealingly accommodated in said secondary chamber (8, 8a);

a second compartment (11, 11a) defined within said secondary chamber (8, 8a) between said secondary piston (10, 10a) and said passage (7, 7a);

a third compartment (14, 14a) defined within said secondary chamber (8, 8a) at an opposite side of said secondary piston (10, 10a) with respect to said passage (7, 7a);

means (15) communicating with said third compartment (14, 14a) for moving said secondary piston (10, 10a) along said secondary chamber (8, 8a), whereby to displace a quantity of said liquid from said second compartment (11, 11a) into said main chamber (3, 3a) to rapidly axially displace said working piston (4, 4a) along said main chamber (3, 3a) and move said stem (5, 5a) into engagement with a workpiece (40) to be treated;

an actuation stem (13, 13a) sealingly slideably penetrating said secondary piston (10, 10a) and axially penetrating said secondary chamber (8, 8a) and said second compartment (11, 11a), said actuating stem (13, 13a) being sealingly slideably engageable within said passage (7, 7a) for transversely penetrating said main chamber (3, 3a), whereby to cause compression of said liquid contained in said main chamber (3, 3a) and increase actuation force on said working piston (4, 4a) and said stem (5, 5a) for treating a workpiece (40);

actuating means (12, 12a, 16, 16a, 17, 17a, 18, 18a) for moving said actuation stem (13, 13a) into said main chamber (3, 3a) through sliding engagement with said passage (7, 7a);

means (19, 19a, 20, 20a) for actuating return motion of said working piston (4, 4a), and;

means (21, 21a, 22, 22a, 23, 23a) for delimiting said working piston stroke;

wherein said actuating means (12, 12a, 16, 16a, 17, 17a, 18, 18a) comprise;

substantially cylindrical actuation chamber (16, 16a) sealingly separated from said secondary chamber (8, 8a);

an actuation piston (12, 12a) connected to said stem (13, 13a) and being slideably sealingly accommodated within said actuation chamber (16, 16a), and;

ports (17, 17a, 18, 18a) arranged on opposite side of said actuation chamber (16, 16a) with respect to said actuation piston (12, 12a) and being connectable to a source of compressed air for axially moving said actuation piston (12, 12a) along said actuation chamber (16, 16a), and;

wherein said means (19, 19a, 20, 20a) for actuating return motion of said working piston (4) comprise;

a fourth compartment (19, 19a) defined between said working piston (4, 4a) and an end of said main chamber (3, 3a), and;

a port (20, 20) defined in said fourth compartment (19, 19a) and being connectable to a source of compressed air, whereby to generate return motion of said working piston (4), wherein said actuation stem (13a), said actuation piston (12, 12a) and said actuation chamber (16, 16a) are eccentric with respect to said secondary piston (10a).

4. Combined pneumatic-hydraulic press according to claim 3, wherein said means (21, 21a, 22, 22a, 23, 23a) for delimiting said working piston stroke comprise;

a shaft (21, 21a) connected to an opposite said of said working piston (4, 4a) with respect to said stem (5, 5a), said shaft protruding from an opposite side of said body (2, 2a) with respect to said stem (5, 5a);

an abutment (23, 23a) defined by said body (2, 2a), and;

a shoulder (22, 22a) provided on said shaft (21, 21a) externally of said body (2, 2a) and being engageable with said abutment (23, 23a) in abutment engagement relationship therewith, wherein said shoulder (22, 22a) comprises a ring (24, 24a), said ring engaging said shaft (21, 21a), in screw thread engagement relationship therewith, whereby to adjustably precisely position said shoulder (22, 22a) on said shaft (21, 21a), and further comprising;

an auxiliary chamber (26, 26a) sealingly separated from said first compartment (6, 6a);

an auxiliary piston (25, 25a) connected to said shaft (21, 21a) and being slideably accommodated in said auxiliary chamber (26, 26a), and;

auxiliary ports (27, 27a, 28, 28a) arranged on opposite sides of said auxiliary chamber (26, 26a) with respect to said auxiliary piston (25, 25a) and connectable to a source of compressed air, whereby to aid said working piston stroke of said working piston (4, 4a) in a working direction (9, 9a).

5. Combined pneumatic-hydraulic press with controlled stroke comprising;

a body (2, 2a);

a main chamber (3, 3a) defined in said body (2, 2a) and being filled with liquid;

a working piston (4, 4a) slideably accommodated in said main chamber (3, 3a) and defining a working piston stroke;

a stem (5, 5a) connected to said working piston (4, 4a) and protruding from said body (2, 2a);

a first compartment (6, 6a) delimited by said working piston (4, 4a) in said main chamber (3, 3a) and being filled with liquid;

a secondary compartment (8, 8a) filled with liquid and being axially transverse with respect to said first compartment;

a passage (7, 7a) interconnecting said first compartment (6, 6a) and said secondary compartment (8, 8a);

a secondary piston (10, 10a) slideably sealingly accommodated in said secondary compartment (8, 8a);

a second compartment (11, 11a) delimited by said secondary piston (10, 10a) within said secondary compartment (8, 8a) between said secondary piston (10, 10a) and said passage (7, 7a);

a third compartment (14, 14a) delimited by said secondary piston (10, 10a) within said secondary compartment (8, 8a) at an opposite side of said secondary piston (10, 10a) with respect to said passage (7, 7a);

means (15) communicating with said third compartment (14, 14a) for moving said secondary piston (10, 10a) along said secondary compartment (8, 8a), whereby to displace a quantity of said liquid from said second compartment (11, 11a) into said main chamber (3, 3a) to rapidly axially displace said working piston (4, 4a) along said main chamber (3, 3a) and move said stem (5, 5a) into engagement with a workpiece (40) to be treated;

an actuation stem (13, 13a) sealingly slideably penetrating said secondary piston (10, 10a) and axially penetrating said secondary compartment (8, 8a) and said second compartment (11, 11a), said actuating stem (13, 13a) being sealingly slideably engageable within said passage (7, 7a) for transversely penetrating said main chamber (3, 3a), whereby to cause compression of said liquid contained in said main chamber (3, 3a) and increase actuation force on said working piston (4, 4a) and said stem (5, 5a) for treating a workpiece (40);

actuating means (12, 12a, 16, 16a, 17, 17a, 18, 18a) for moving said actuation stem (13, 13a) into said main chamber (3, 3a) through sliding engagement with said passage (7, 7a);

means (19, 19a, 20, 20a) for actuating return motion of said working piston (4, 4a), and;

means (21, 21a, 22, 22a, 23, 23a) for delimiting said working piston stroke;

wherein said actuating means (12, 12a, 16, 16a, 17, 17a, 18, 18a) comprise;

substantially cylindrical actuation chamber (16, 16a) sealingly separated from said secondary chamber (8, 8a);

an actuation piston (12, 12a) connected to said stem (13, 13a) and being slideably sealingly accommodated within said actuation chamber (16, 16a), and;

ports (17, 17a, 18, 18a) arranged on opposite side of said actuation chamber (16, 16a) with respect to said actuation piston (12, 12a) and being connectable to a source of compressed air for axially moving said actuation piston (12, 12a) along said actuation chamber (16, 16a), and;

wherein said means (19, 19a, 20, 20a) for actuating return motion of said working piston (4) comprise;

a fourth compartment (19, 19a) defined between said working piston (4, 4a) and an end of said main chamber (3, 3a), and;

a port (20, 20) defined in said fourth compartment (19, 19a) and being connectable to a source of compressed air, whereby to generate return motion of said working piston (4), said press further comprising;

an auxiliary chamber (26, 26a) sealingly separated from said first compartment (6, 6a);

an auxiliary piston (25, 25a) connected to said shaft (21, 21a) and being slideably accommodated in said auxiliary chamber (26, 26a), and;

auxiliary ports (27, 27a, 28, 28a) arranged on opposite sides of said auxiliary chamber (26, 26a) with respect to said auxiliary piston (25, 25a) and connectable to a source of compressed air, whereby to aid said working piston stroke of said working piston (4, 4a) in a working direction (9, 9a), and;

a stroke-limit abutment (33, 33a) defined by said body (2, 2a);

an actuation shaft (30, 30a) connected to said actuation piston (12, 12a), at an opposite side thereof with respect to said stem (13, 13a), a portion of said actuation shaft protruding from said actuation chamber (16, 16a) and being threaded;

an adjustment ring threadedly engaging said portion of said actuation shaft protruding from said actuation chamber (16, 16a) and being engageable with said stroke-limit abutment (33, 33a) in abutment engagement relationship therewith.

* * * * *